United States Patent [19]

Winner

[11] Patent Number: 5,014,466

[45] Date of Patent: May 14, 1991

[54] WINDOW ASSEMBLY

[76] Inventor: Kurt Winner, 22 Fairmount Ave., Mahwah, N.J. 07430

[21] Appl. No.: 386,985

[22] Filed: Jul. 28, 1989

[51] Int. Cl.[5] ..... E06B 1/04

[52] U.S. Cl. ..... 49/504; 49/161; 49/449; 49/505; 52/213; 52/775; 52/780; 52/790

[58] Field of Search ..... 49/504, 505, 380, 181, 49/161, 449, 460; 52/656, 788, 790, 766, 775, 776, 780, 781, 213

[56] References Cited

U.S. PATENT DOCUMENTS

| | | | |
|---|---|---|---|
| 2,927,354 | 3/1960 | Lauer | 52/656 X |
| 3,250,049 | 5/1966 | Sklar | 52/213 X |
| 3,411,247 | 11/1968 | Fleming | 52/790 X |
| 3,585,770 | 6/1971 | Maizler | 49/504 X |
| 3,703,063 | 11/1972 | Budich et al. | 49/504 X |
| 3,959,926 | 6/1976 | Noecker et al. | 49/181 |
| 3,982,371 | 9/1976 | Preu | 52/775 X |
| 4,226,050 | 10/1980 | Kessler | 49/181 |
| 4,259,813 | 4/1981 | Winner et al. | 49/504 |
| 4,351,131 | 9/1982 | Kubik | 49/504 X |
| 4,370,830 | 2/1983 | Schaefer et al. | 49/504 X |
| 4,525,952 | 7/1985 | Cunningham et al. | 49/181 X |
| 4,624,073 | 11/1986 | Randall | 49/161 |
| 4,640,048 | 2/1987 | Winner et al. | 49/181 |
| 4,694,612 | 9/1987 | Pruden | 49/504 X |
| 4,869,020 | 9/1989 | Andres | 49/161 |

*Primary Examiner*—Philip C. Kannan

*Attorney, Agent, or Firm*—Ostrolenk, Faber, Gerb & Soffen

[57] ABSTRACT

Extruded frame elements include a pair of opposed parallel jambs, a sill, and a header. A selected pair of opposite frame elements each contain a longitudinal channel; and metal, beam-like reinforcing members within these channels. The other two frame elements may also have reinforcing members. The sill is stepless and has a generally uniform, inside-to-outside downward slope. An upward-projecting lip on the sill, and a downward-projecting lip on the lifting ledge of the lower rail, have engaging surfaces which limit the outward deflection of the lower rail under tornado (low pressure) conditions. A pair of wind load stop elements project into the window opening from the jambs, adjacent the outer surfaces of the stiles of the inner sash unit. The inner sash has a hurricane stop element on each of its stiles, projecting sideways, so as to engage the jambs and limit the inward deflection of the stiles under hurricane (high pressure) conditions. Each rail and stile in each sash may have arms which extend on either side of the window pane assembly and contact the two panes at holding surfaces of the arms. A chevron-shaped longitudinal channel may be defined adjacent to the holding surface of each arm, and a corresponding adhesive key may be formed on each pane and engage the corresponding channel.

45 Claims, 8 Drawing Sheets

WINDOW ASSEMBLY

BACKGROUND OF THE INVENTION

This invention relates to window assemblies in which the frame and the sashes of each of the window units are constructed of extrusions, typically of rigid plastic or aluminum.

Extruded elements assembled to form window frames and sashes are disclosed in my U.S. Pat. No. 4,259,813 issued Apr. 7, 1981 for a Plastic Window and in my U.S. Pat. No. 4,640,048 issued Feb. 3, 1987 for a Window Sash Assembly. A double-hung window assembly is described in U.S. Pat. No. 4,259,813. U.S. Pat. No. 4,640,048 describes a lower window unit, known as an inner sash, that is vertically slidable and is also inwardly tiltable about a horizontal axis located at the lower rail of the sash.

In window assemblies of this type a significant design goal is to provide a unit that is light in weight yet is strong enough to withstand mechanical stresses without undue flexing and will provide good sealing against air and water leaks.

SUMMARY OF THE INVENTION

In accordance with an aspect of the instant invention a window assembly having two vertically slidable and inwardly tiltable sashes is assembled from frame and sash elements that are constructed of elongated hollow extrusions, some of which may be reinforced against undue flexing by the insertion of a metal beam-like longitudinally extending reinforcing member. Typically such reinforcing members are provided for the two longer elements of the rectangular frame, but the shorter elements may also have reinforcing members.

In each sash, typically at least one rail is also provided with a reinforcing member. In the lower sash, which conventionally is the rear or inner unit of the window, the upper rail may be provided with a reinforcing member, while in the upper sash, conventionally the front or outer unit of the window, the lower rail may be provided with a reinforcing member.

According to a further feature of the invention, the side elements or jambs of the frame may have a stepless design. This is in contrast to a stepped design, in which protrusions on the jambs define guide channels that partially overlap the stiles of the sash. However, the jambs do have longitudinal protrusions that overlap parts of the front or outside surfaces of the stiles of the outer sash.

According to another aspect of the invention, the sill of the frame has a stepless construction so that there is a continuous sloping drain surface that extends below both sashes. A lip extends upward from the inner edge of the sloping sill surface. Along the upper edge of this lip there is an inwardly extending bead which normally closely bypasses a bead that extends essentially the full length of the lower rail of the inner sash. The bead on the lower rail of the inner sash is on the underside of a ledge that extends inward from the lower rail. When an extreme negative pressure exists outside the window these lips engage so that the lip on the sill acts to brace the lower sash against outward deflection.

A further feature of the invention relates to two sealing strips which are secured to the lower surface of the lower rail to contact the sloping sill. When the inner window unit is closed the outer one of these sealing strips, a single strip of deflectable elastomer material, is tilted outward. The inner strip may be a brush-type seal.

In another feature of the invention, the sash is provided with at least a pair, preferably two pairs, of integrally formed parallel beads or fingers which engage the opposite outer surfaces of the window panes adjacent the periphery of the window panes. These fingers are deflectable and in cross-section are angled toward the periphery of the window pane so that if a force is applied in a direction which tends to move the opposite stiles or rails of the sash apart, the fingers tend to straighten and by so doing provide an increased gripping force between the window pane and the sash, to resist the force tending to separate the sash elements.

In a further embodiment, the arms of the rails and stiles contact the window pane assembly via holding surfaces spaced from the main body portions of the rails and stiles. A chevron-shaped longitudinal channel is defined adjacent the holding surface of each arm, and an adhesive key is formed on each pane to engage the corresponding channel.

According to a further aspect of the invention, the frame may have a stepped design. In a window with such a frame, a deflectable spring element that is constructed of resilient sheet metal, or another spring-loaded device, protrudes sideways from each of the stiles of both sashes midway along its length. The shape and mounting of these springs is such that they are normally partially deflected so as not to interfere with tilting the sashes and to permit the latter to slide within the frame. These elements are in frictional engagement with the jambs of the frame when the sashes slide with respect to the jambs. However, when the sashes are closed (inner sash down and outer sash up), these deflectable elements are aligned with notches in the jambs, so the deflectable elements extend to their normal fully projected positions. In these positions, they extend sideways into the jamb. They are thus disposed in a blocking relationship with portions of the jambs so that they cooperate therewith to prevent any excessive inward deflection of the sashes when an inwardly directed force is applied to either or both sashes.

Deflectable spring elements can also be provided when the frame is not stepped, but only on the inner sash, since in a non-stepped frame, the outer sash would not freely tilt rearward if such spring elements were present.

Accordingly, a primary object of the instant invention is to provide an improved construction for a window assembly of the type in which the extruded elements are used to form the frame and sashes for the window units.

Another object is to provide a window assembly of this type in which some or all of the extruded frame and sash members define chambers which may receive metal beam-like longitudinally extending reinforcing members.

Still another object is to provide a window assembly of this type having means to rigidify the assembly against inwardly directed forces.

A further object is to provide a window assembly of this type in which the sill has a stepless construction and there are cooperating passive engagement catch members at the inside of the sill and extending substantially for the entire width of the inner sash unit to prevent outward deflection of the lower stile under negative wind loads.

Yet another object is to reduce the manufacturing costs of a window assembly by reducing the amount of wasted material, reducing the number of processing steps and simplifying the necessary tooling.

Another advantageous feature is that the jambs of the frame simply butt against the sill and the header. This eliminates the tooling, manufacturing steps and wasted material that would be required for the notching of the sill and the header in a conventional construction.

In this disclosure the window assembly may be considered to be mounted in a building or other structure, although the invention is not limited to a mounted window assembly. The terms "inward" or "rearward" will usually be employed to refer to the side of the window assembly that is toward the inside of such building. At times, in other contexts, the term "inward" may also be used to refer to a direction radially inward with respect to the frame of the assembly, that is, within its periphery. Corresponding uses will be made of the terms "outward" and "frontward."

BRIEF DESCRIPTION OF THE DRAWINGS

These objects as well as other objects of this invention shall become readily apparent after reading the following, description of the accompanying drawings in which.

DETAILED DESCRIPTION OF EMBODIMENTS THE INVENTION

Stepless Frame Construction

Figure 1:
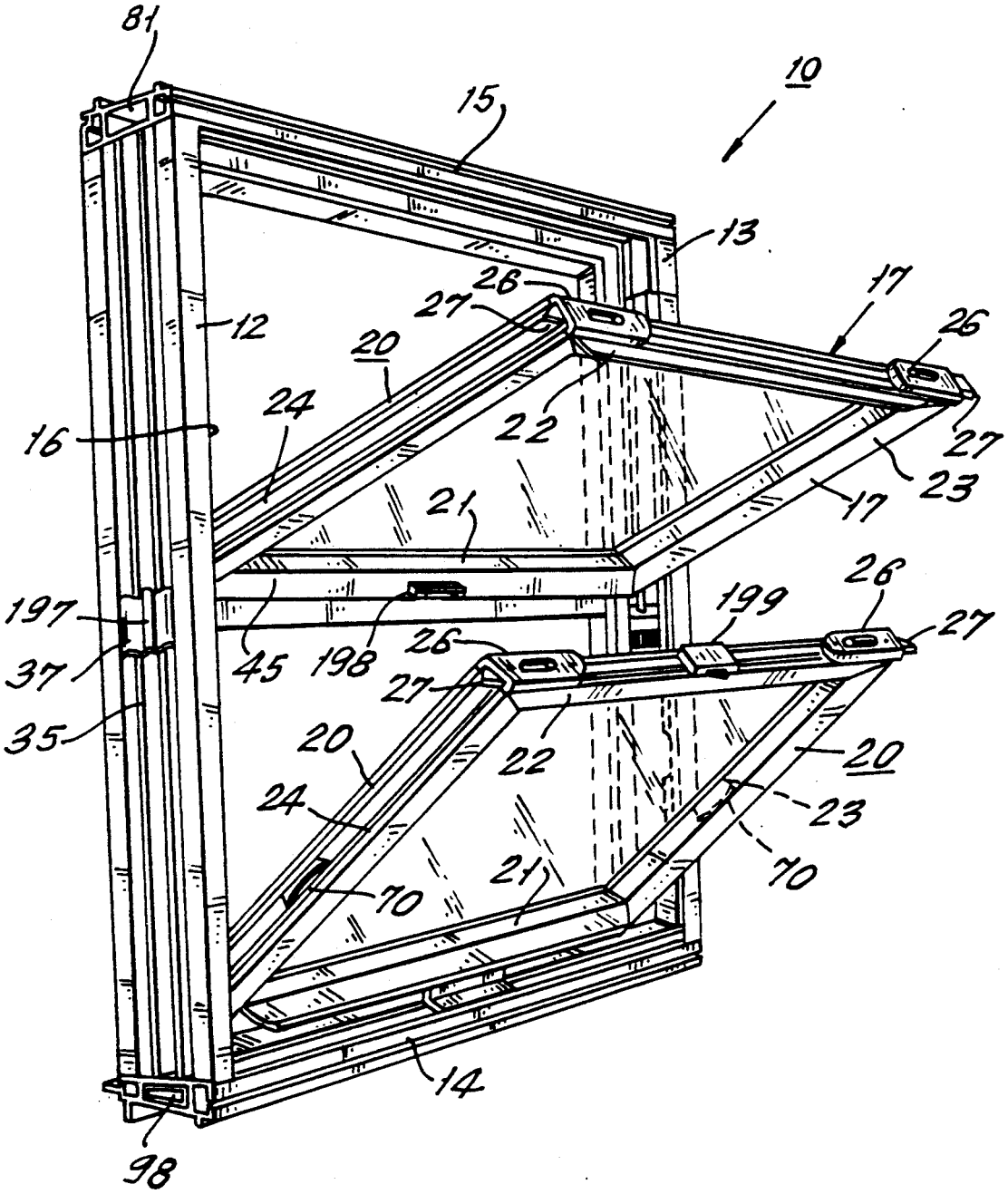
FIG. 1 is a perspective view of a window assembly constructed with a stepless frame in accordance with an embodiment of the instant invention, with the inner and outer sash units, partially tilted inward.

Now referring to the Figures, reference numeral 10 designates an embodiment of a window assembly constructed in accordance with teachings of the present invention. Assembly 10 includes a rectangular frame 11 formed of extruded side elements or jambs 12, 13 joined at their lower ends by an extruded horizontal sill 14 and at their upper ends by an extruded horizontal header 15. Elements 12–15 cooperate to define a rectangular opening 16 wherein outer sash unit 17 and inner sash unit 20 are disposed for vertical sliding movement. Rather than conventional mitre connections being formed where elements 13–15 abut one another, strong joints are obtained in this embodiment, while reducing the amount of scrap material and requiring little or no secondary processing, by forming the sill 14 and header 15 from lengths of material which are cut at right angles to the lengths thereof. Thus, both header 15 and sill 14 extend the full width of frame 11 and overlie the ends of jambs 12, 13. The elements 12–15 are mechanically secured at each corner of frame 11 by merely utilizing two self-threading screws 186, 187 (FIG. 2) that pass through respective clearance holes 184, 185 which extend transversely through header 15 and sill 14. Holes 184, 185 (FIG. 2) are aligned with longitudinal passages 188, 189, respectively, in jambs 12 and 13 (FIGS. 3 and 4) and the respective screws 186, 187 threadably engage the passages 188, 189 to form a secure mechanical joint.

In a manner known to the art, each of the sash units 17, 20 is also pivotable with respect to frame 11 by having aligned pivot bars 18 (FIGS. 3 and 4) which project from opposite ends of the lower rail 21 of each sash into pivot blocks 19 which, also in a manner known to the art, are vertically slidable in jamb channels designated 29 for inner sash 20 and 34 for outer sash 17. For each sash 17 and 20, latch units 26 are secured to the upper surface of its upper rail 22 at opposite ends thereof so that sliding latches 27 of unit 26 project beyond stiles 23, 24 for insertion into the upper portions of slots 28 that constitute entrances to each of the channels 29, 34.

A conventional cam lock (FIG. 1) comprising engageable sections 198, 199 is provided, with section 198 being secured to the upper surface of the lower rail 45 for outer sash 17 and section 199 being secured to the upper surface of the upper rail 22 for inner sash 20.

Figure 3:
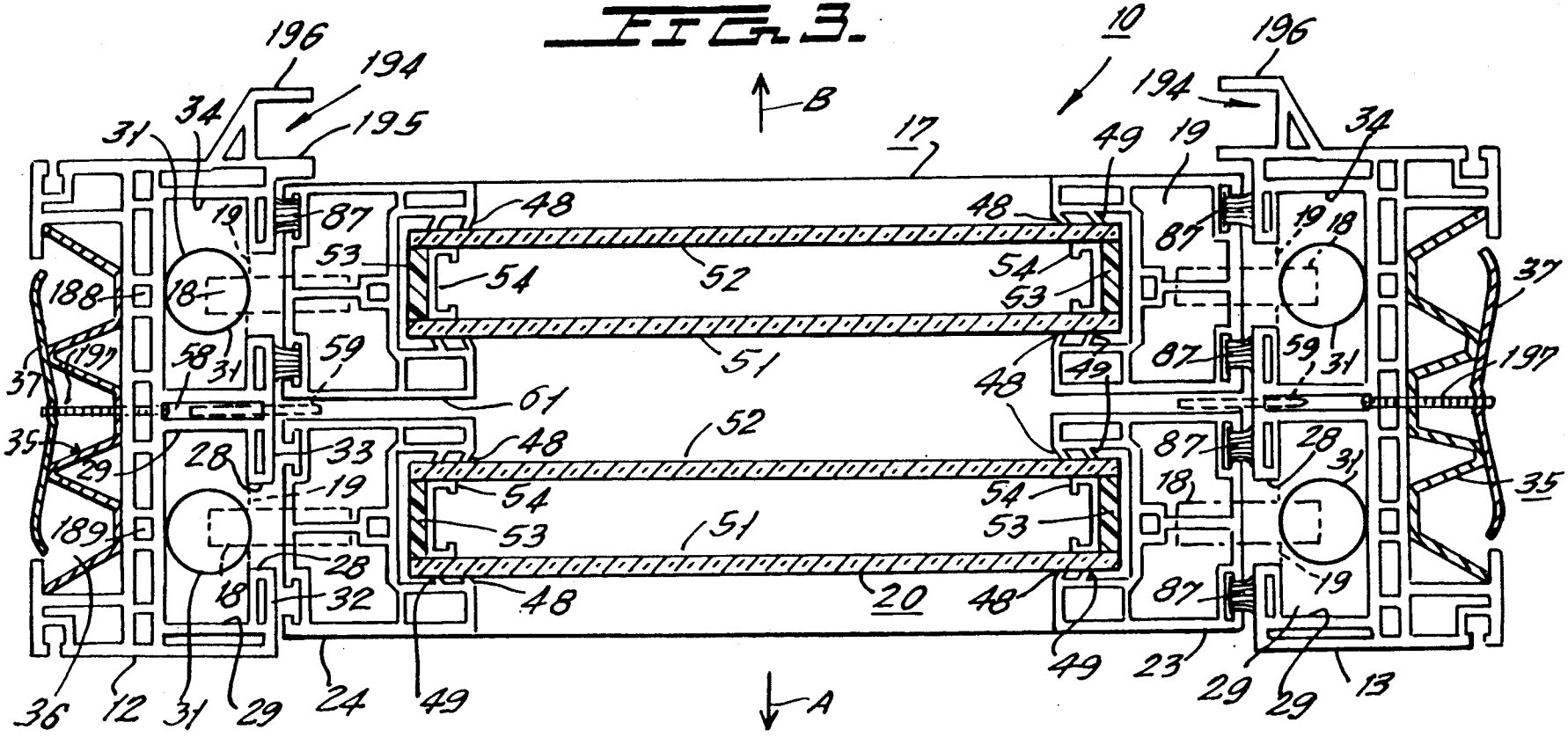
Figure 4:
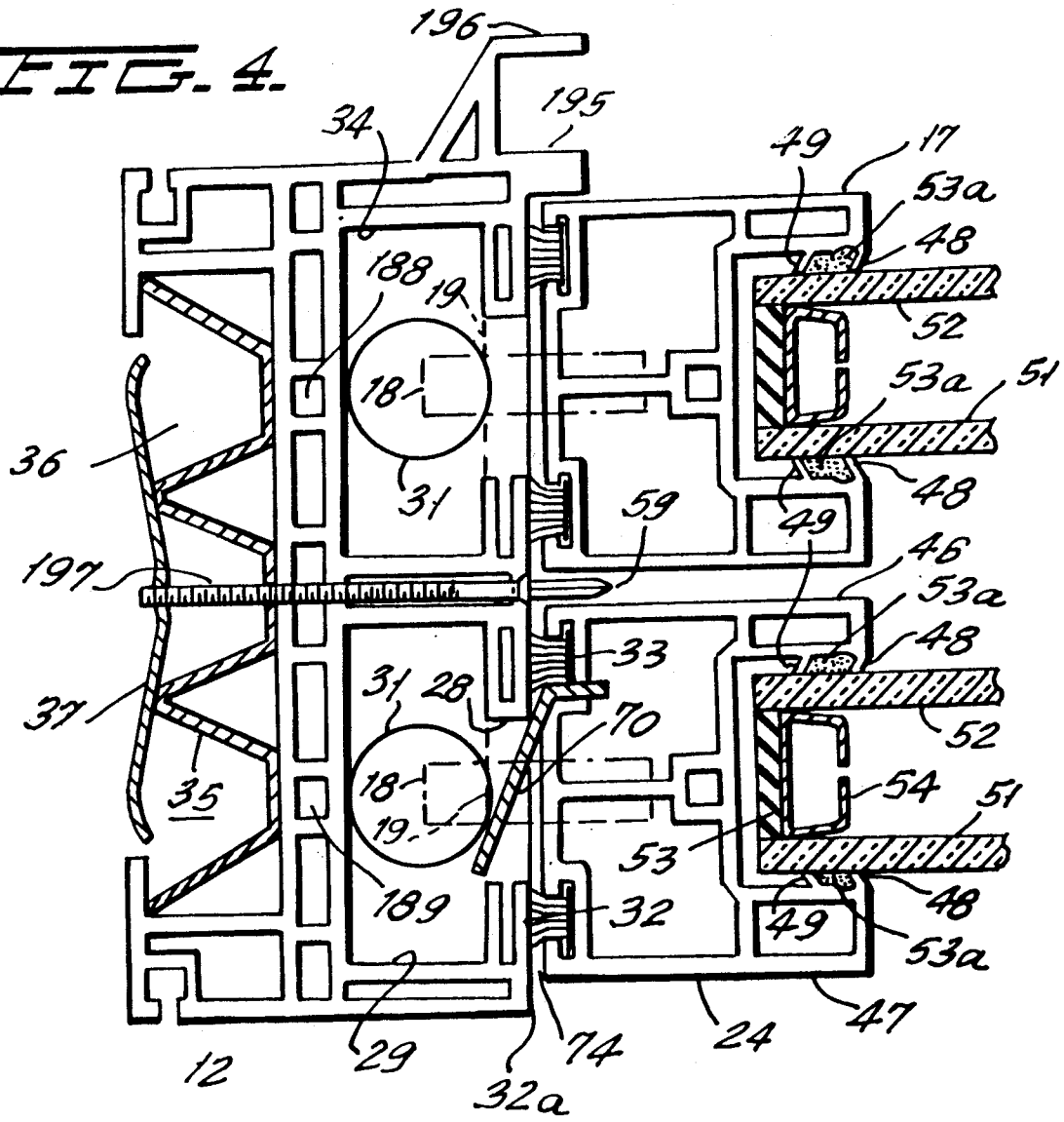
FIG. 4 is a cross-sectional view corresponding to the left-hand portion of FIG. 3, taken through the outer and inner sashes in their closed position, and showing a deflectable stop spring on the inner sash.

As best seen in FIGS. 3 and 4, each of the jambs 12, 13 is an extruded member typically constructed of relatively rigid vinyl and defines a plurality of longitudinally extending channels or chambers including rectangular channels 29, 34 each having slot 28 as a side entrance thereto. A pivot block 19 is disposed within the lower portion of each channel 29 with the channel acting as a vertical guide for the block. The upper portion of each channel 29 houses portions of an individual counterbalance mechanism 31 to which block 19 is connected. The inward side of channel 29 (toward the window opening 16) is defined by coplanar inner and outer wall sections 32, 33, respectively, which cooperate to form slot 28 through which pivot bar 18 extends and moves as block 19 moves in channel 29. Disposed adjacent to and toward the outside of the assembly from channels 29 are channels 34 which are the same shape as channels 29. Each channel 34 guides an individual pivot block 19 and houses an individual counterbalance unit 31 that is attached to outer sash unit 17 which is closed when it is in the up position.

Longitudinal formations 196 are disposed forwardly of formations 195 so as to form channels 194 for retaining a screen over the outside of the window assembly.

Additional stiffening of frame 11 may be accomplished by providing an individual reinforcing member in the form of a metal tube 99 (FIG. 2) that is disposed within a longitudinal chamber in any of the elements 12–15. In the case of sill 14 the chamber 98 is disposed below main upper wall 97. Header 15 may also be provided with a beam-like longitudinally extending reinforcing member which will be disposed within chamber 81.

Reinforcing Members

Chamber 36 (FIGS. 3 and 4), which is generally open at the outside of jamb 12, contains a metal beam-like longitudinally extending reinforcing member 35 that is a relatively stiff metal element of zig-zag cross-section. Conventional type deflectable steel jamb adjusters 37 abut reinforcing member 35, one on each side of the window, and are extendible across the open side of chamber 36. An individual adjusting screw 197 is threadably engaged with each adjuster 37 to deflect the latter as required. By means of the combination of the metal reinforcing member 35 and the jamb adjuster 37, a firm contact with a wall surrounding the window assembly is provided, and a single adjuster 37 can stiffen the entire side of the frame. Thus, this arrangement is substantially stiffer than prior art frame and jamb adjuster arrangements which relied upon an insecure vinyl-to-wall interface.

Sash Construction

Figure 2:
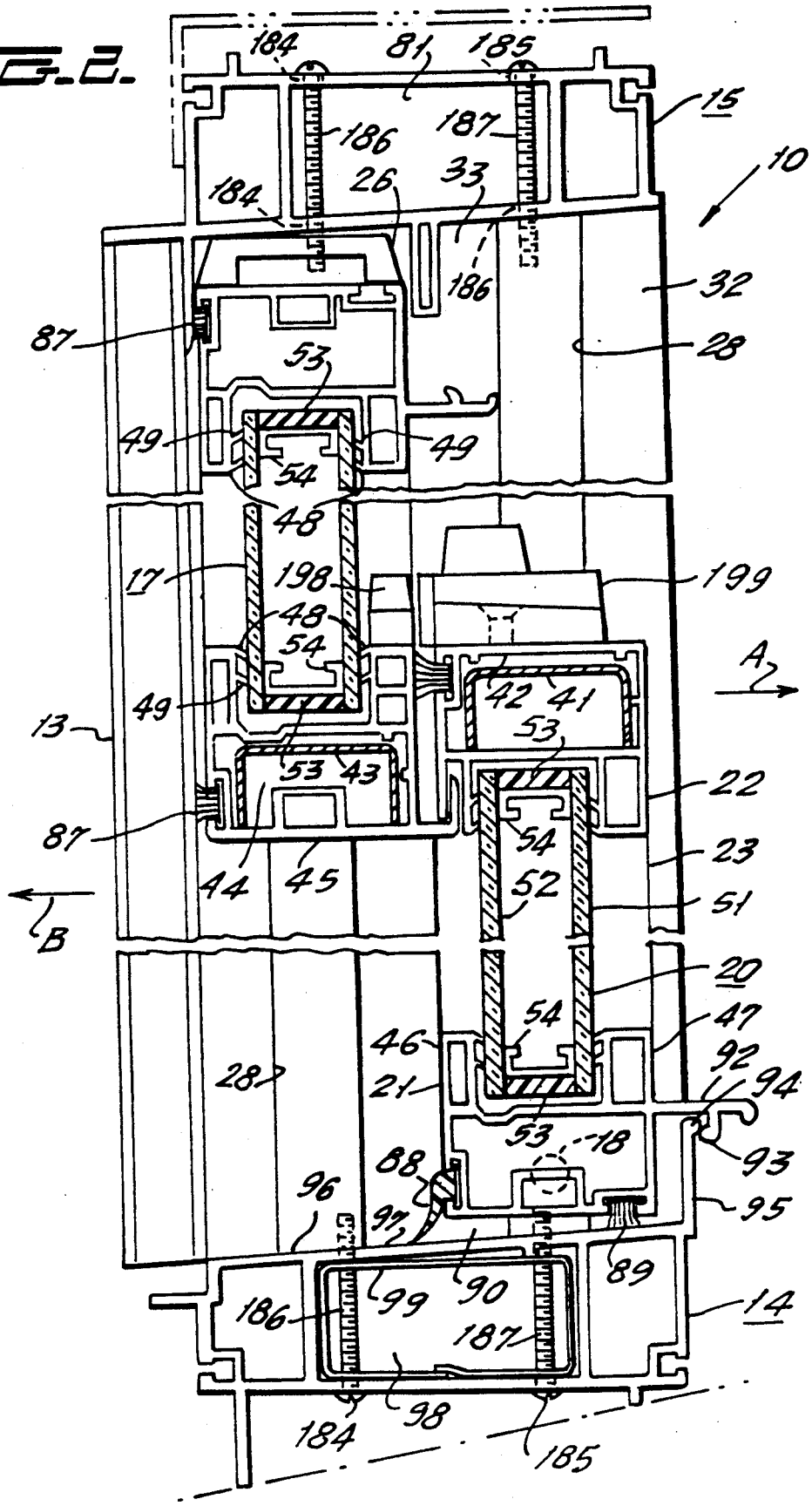
FIGS. 2 and 3 are respectively vertical and horizontal cross-sections of the window assembly of FIG. 1.

Rails 21, 22 and stiles 23, 24, which combine to form the rectangular sash of inner sash unit 20, are elongated hollow extruded members, preferably constructed of relatively stiff vinyl. At least one of the sash forming members 21-24 is provided with a beamlike longitudinally extending reinforcing member. As best seen in FIG. 2, in particular, a U-shaped metal reinforcing member 41 extends for substantially the full length of upper rail 22 and is disposed within a generally rectangular chamber 42 thereof. A similar U-shaped metal reinforcing member 43 is disposed within a generally rectangular chamber 44 in lower rail 45 of outer window unit 17.

Each of the rails 21, 22 and stiles 23, 24 is somewhat U-shaped. For example, in cross-section lower rail 21 includes horizontally spaced upwardly extending arms 46, 47. Each has a pair of parallel beads the cross-sections of which form fingers 48, 49. The latter extend for the entire length of rail 21 and the free ends thereof engage glass panes 51, 52 near the edges thereof. The spacing between panes 51, 52 is maintained by a channel-shaped metal strip 54 (FIG. 4). Adhesive sealant 53 outward of strip 54 extends around the periphery of panes 51, 52 and forms a seal therebetween. Fingers 48, 49 are inclined toward the periphery of panes 51, 52 and are in frictional engagement with panes 51, 52. If a force is applied which tends to separate rails 21, 22 the frictional engagement between panes 51, 52 and fingers 48, 49 will act so as to bring the inclination of fingers 48, 49 toward right angles with respect to panes 51, 52, but as this occurs, fingers 48, 49 exert an increasing force on panes 51, 52, so as to generate a force that opposes the force tending to separate rails 21, 22.

Figure 4B:
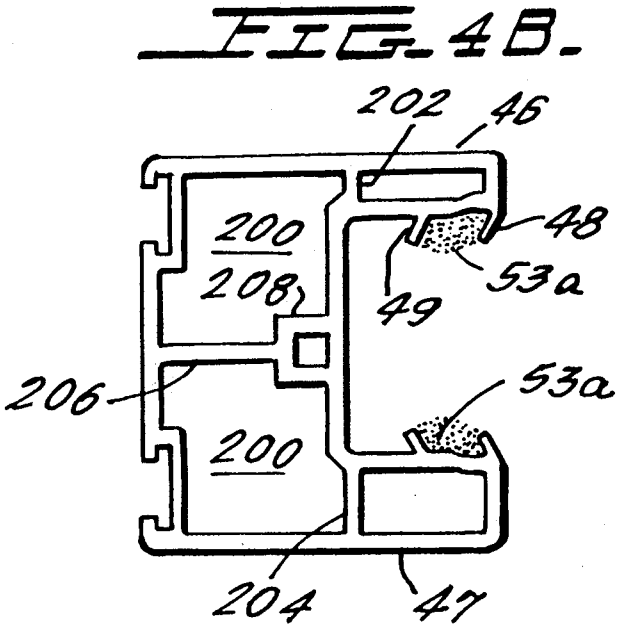
FIGS. 4B and 4C, respectively, are cross-sectional and enlarged partial cross-sectional views of embodiments of the sash rails and stiles of the invention, and particularly showing their means for retaining the window panes.

As shown in FIGS. 4 and 4B, additional adhesive sealant **53*a* may be disposed between the fingers 48, 49. A radius 53*b* is formed peripherally outward from each of the fingers 48 and serves as a reservoir for the adhesive sealant 53*a***.

Great strength and stability are obtained with the illustrated form of the rails and stiles 21–24. These rails and stiles 21–24 each comprise a main body portion 200 from which the opposed arms 46, 47 project. The fingers 48 and 49 project in turn from the arms 46, 47 for engaging the front and back panes 51, 52.

A substantial improvement in strength over prior art structures is obtained by means of only three internal stiffening webs. First and second webs 202, 204 extend substantially across the interior of the arms 46, 47 respectively, near the main body portion 200. A third stiffening web 206 extends substantially through the middle of the main body portion 200, substantially parallel to the panes. The web 206 has a bifurcated portion defining a screw channel 208 at the end thereof near the panes, which preferably is sized for receiving a self-tapping screw, or has threads tapped therein for receiving a screw. The screw channel 208 permits an adjacent rail and stile to be securely connected together at a mitered connection thereof by only a single screw.

Alternate Sash Construction

Figure 4C:
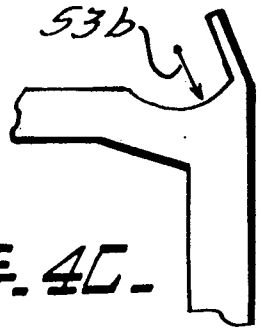

Although the foregoing embodiment of rail and stile construction is in many respects a substantial improvement over the prior art, portions of it are rather difficult or expensive to manufacture, particularly the outer fingers 48 and the radius **53*b* adjacent thereto (FIG. 4C**). It would be desirable to simplify the manufacturing process.

Figure 8:
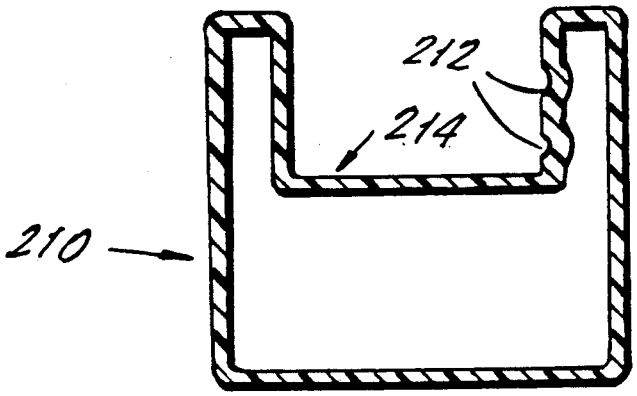
FIG. 8. PRIOR ART
FIGS. 8–10 illustrate respective prior art rail or stile constructions.

Other aspects of the rail and stile construction could also be improved. FIG. 8 illustrates a prior art rail (or stile) structure 210 which is hollow and has very little mechanical strength. A pair of grooves 212 are formed in one of its arms to receive a quantity of adhesive sealant (not shown). Such sealants are known to bond well to glass, but not to bond as strongly to the vinyl material from which the rail 210 is formed. This structure deglazes easily due to its poor mechanical strength when even minor forces are applied to it. A further problem is that the double-pane window structure must be exactly the same width of the channel formed by the rail 210. Furthermore, it must be forced into the channel to form a good seal. Frequently, this assembly process has resulted in cracking the panes, bending the rail, or both.

Figure 9:
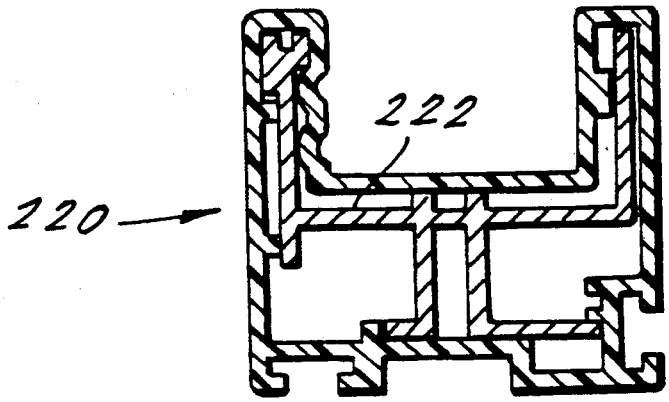
FIG. 9. PRIOR ART

FIG. 9 illustrates an improvement over the rail of FIG. 8. Substantial mechanical strength and rigidity are obtained in a rail 220 which has an aluminum armature 222. When these rails are mitered at their ends and adjacent rails (and stiles) are interconnected by a single screw, great resistance to bending is obtained. However, such a structure is extremely heavy and expensive to manufacture.

Figure 10:
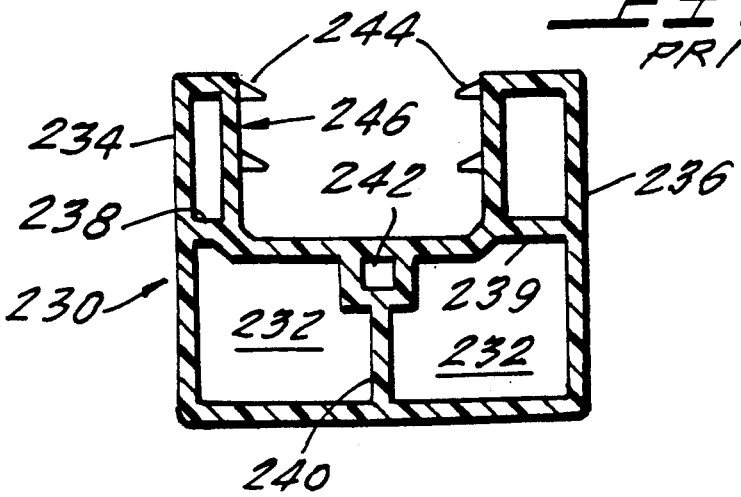
FIG. 10. PRIOR ART

Another prior art rail 230 is shown in FIG. 10. This rail structure has a cross-section somewhat similar to that shown in FIG. 4B, in that it has a main body portion 232 and a pair of arms 234, 236 extending therefrom to surround the panes (not shown). First, second and third stiffening webs 238, 239, 240 provide a certain degree of rigidity. A bifurcated portion defines a screw channel 242 for receiving a screw.

A plurality of inwardly projecting fingers 244 for gripping the panes are formed on the surfaces of the arms 234, 236 facing the panes. The fingers 244 are formed by co-extrusion of a thermoplastic material which is somewhat softer than the remainder of the material in the rail. A silicone adhesive, for example, may also be added in a groove 246 defined between a pair of fingers 244.

The fingers and silicone adhesive of this prior art rail structure were thought to be highly desirable as a weather seal and for gripping the panes. However, it has been found that the fingers 244, even with the additional adhesive sealant 246, does not form a good seal. It would be desirable to employ a true elastomeric material as the fingers 244 to improve the seal, but this cannot be done, since true elastomers are not thermoplastic and cannot be co-extruded onto vinyl. Thus, a relatively poor seal is formed in this structure. Also, the beam strength and gripping strength of this structure could desirably be improved. De-glazing sometimes occurs with a mid-beam pull of only about 40 pounds.

Figure 11:
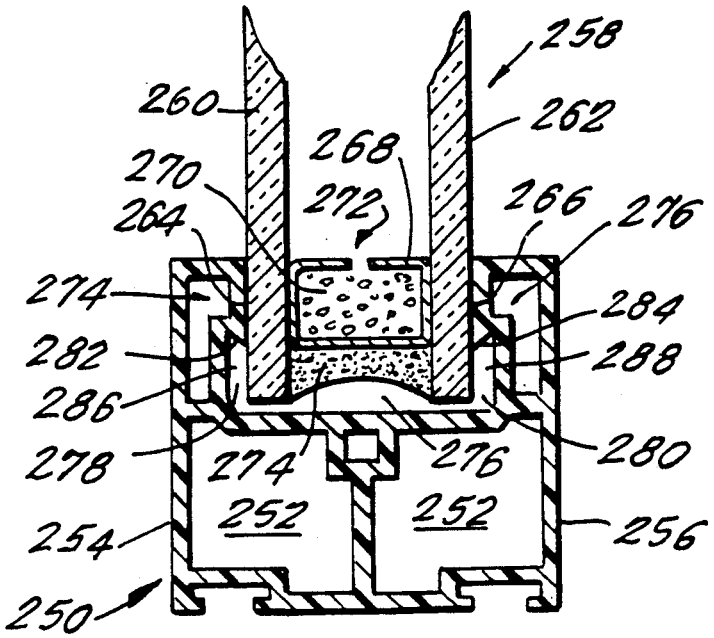
FIG. 11 is a cross-sectional view of a rail or stile arrangement according to an alternate embodiment of the invention.

FIG. 11 is a cross-sectional view of an alternate embodiment of a rail (or stile) 250 according to the invention, which avoids all the foregoing disadvantages. This rail 250 has a main body portion 252 and a pair of arms 254, 256 which extend so as to surround a window pane assembly 258. The window pane assembly 258 comprises in this example a pair of panes 260, 262 which respectively abut inward-facing, substantially flat holding surfaces 264, 266 of the arms 254, 256.

A conventional aluminum spacer 268 separates the panes 260, 262. The spacer 268 contains a quantity of desiccant material 270, and has a seam defining a slight gap 272 directed toward the space between the panes. In known fashion, after the window is assembled, the desiccant material will absorb any water vapor remaining between the panes.

Between the panes, and more specifically between the spacer 268 and the periphery of the panes, a sealant material 274 is applied. The sealant may be of any suitable type, such a butyl or polysulfide sealant. An air space 276 may be formed between the sealant material and the main body portion 252 of the rail 250.

The holding surfaces 264, 266 advantageously face the spacer 268, so the spacer will absorb all forces exerted on the panes, avoiding damage to the panes. The surfaces 264, 266 extend a substantial distance over the outer surfaces of the respective panes 260, 262, and thus they apply pressure over a substantial two-dimensional contact area.

The surfaces 264, 266 are formed as the inward-directed surfaces of respective enlarged portions 274, 276 of the arms 254, 256. Between the enlarged portions 274, 276 and the main body portion 252, a pair of channels 278, 280 are defined between the arms and the corresponding panes. According to a highly advantageous feature, the parts of the enlarged portions 274, 276 nearest the main body portion 252 define a pair of chevron-shaped protrusions 282, 284. These protrusions are defined respectively by the holding surfaces 264, 266, and also by the surfaces of the enlarged portions 274, 276 which face the main body portion 252. Correspondingly, the channels 278, 280 are defined in part by acute angles formed in the inward-facing surfaces of the arms, at the points between the enlarged portions and the rest of the arms.

A quantity of an adhesive, such as a silicone adhesive, is formed on each pane at a position corresponding to the respective channel 278, 280. This quantity of adhesive will be referred to herein as an "adhesive key." This type of adhesive is known to bond 100% to the glass and thereby becomes a structural member of the window assembly. The portion of the adhesive key 286, 288 away from the periphery of the pane is formed with a chevron-shape so as to interlock with the protrusions 282, 284 of the arms and thereby form an extremely secure key arrangement. With this key arrangement the window pane assembly 258 cannot be withdrawn from the rail 250, even if, for some reason, some degree of force is exerted to spread the arms away from the window pane assembly, since the adhesive key is interlocked with the angled portions of the arms.

This adhesive key arrangement makes the known structure of first, second and third stiffening webs practical and extremely effective as a structure for a rail. Although some degree of flexing, bending or warping is possible with only these three stiffening webs, this degree of flexing is tolerable because of the highly advantageous adhesive key arrangement.

Silicone adhesives, and the labor involved in applying them, may be costly. However, it is only necessary to apply the adhesive key over part of the beam length of the rail, perhaps 70–80% for example. The highly effective interlocking between the adhesive keys and the corresponding arms makes it unnecessary to extend the adhesive keys over the entire length of the panes. In most cases, the adhesive key need be present only in the part of the span, perhaps only the center 25% of its length. This will minimize the linear expansion differential between the glass and the plastic frame.

With this embodiment of the invention, a 70-pound load at the middle of a rail is easily tolerated. Any need for expensive co-extruded lips or fingers, or for a metal beam in the rail, is eliminated.

According to a further feature of the adhesive key arrangement, the invention solves the problem of differential thermal expansion between the frame and the glass. A long standing problem in the manufacture of windows is that the glass and the window frame surrounding it undergo different degrees of thermal linear expansion. This problem is avoided by the embodiment of FIG. 11, since there is no fixed mechanical bond between the window pane assembly 258 and the rail 250. Rather, a degree of slippage in the length direction of the rail is possible between the surfaces 264, 266 and the corresponding panes 260, 262.

Also, a releasing agent is advantageously applied to the inward-facing surface of each arm in the channels 278, 280. Such a releasing agent may be liquid silicone or a wax-type product, for example, or another known type. Such releasing agent will prevent any strong bonding between the silicone adhesive of the adhesive key and the vinyl material of the arm. Thus, as the frame expands and contracts, it is free to move slightly with respect to the panes, yet a secure connection is maintained and the risk of de-glazing is not increased, because of the highly effective adhesive key arrangement of this invention.

Additionally, the embodiment of FIG. 11 avoids the problem of stress cracks and the like that may occur with the prior art rail of FIG. 8, for example, because the window pane assembly does not have to be forced into the rail, and also because the spacer 268, being interposed substantially between the surfaces 264, 266, takes up any strong forces applied by the respective arms 254, 256.

Figure 12:
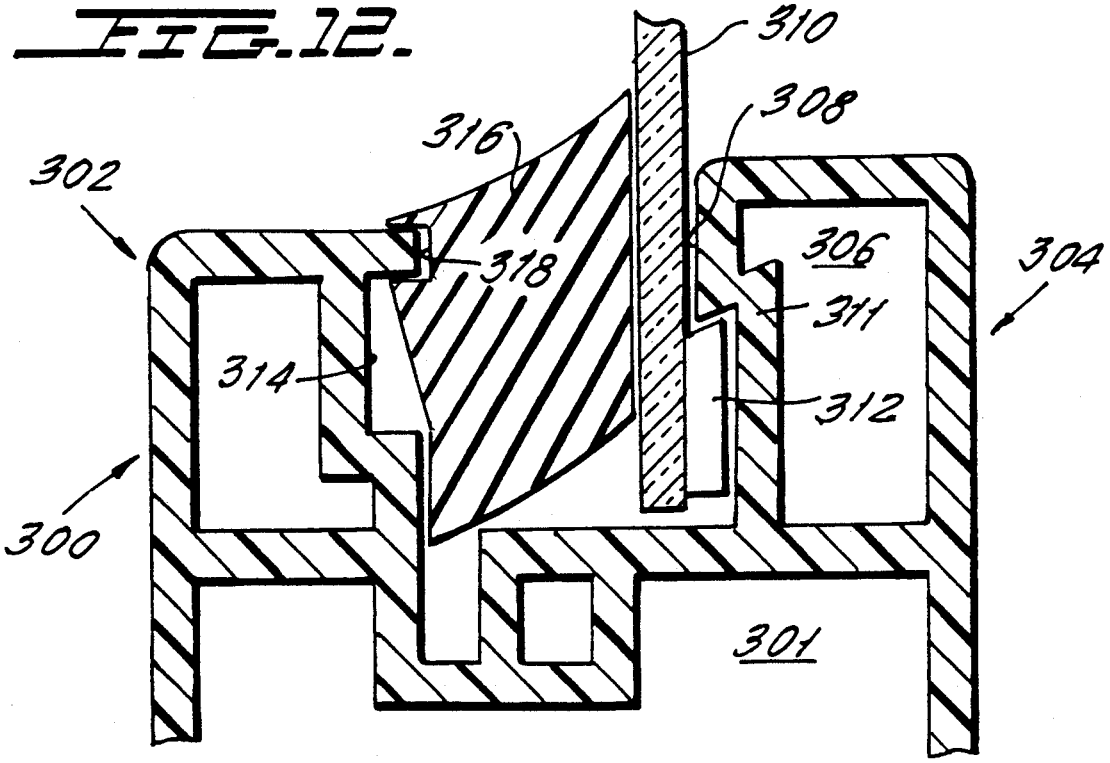
FIG. 12 is a cross-sectional view of a rail or stile arrangement according to a further embodiment of the invention.

Another embodiment of the invention is shown in FIG. 12, in which there is an adhesive key on only one pane, rather than on two panes as shown in FIG. 11. This is a particularly important feature in warm climates, where a two-pane insulating window pane assembly is not necessary. Thus, the embodiment of FIG. 12 can provide a substantial reduction in cost.

FIG. 12 shows a rail (or stile) 300 comprising a pair of arms 302, 304. The arm 304 has an enlarged portion 306 with a holding surface 308 which faces and contacts the pane 310 over a substantial contact surface area. Between the surface 308 and the main body portion 301 a chevron-shaped set-back 311 defines a channel 312 which, as is shown in FIG. 1, is substantially occupied by an adhesive key bonded securely to the pane 310.

The other arm 302 has a cut-out or the like 314 formed therein. An elastomeric gasket 316 is interposed between the pane 310 and the arm 302. Advantageously, a groove or the like 318 is formed in the gasket 316 for engaging a portion of the arm 302 adjacent the cut-out 314, thus holding the gasket 316 in place. The gasket 316 may be made of an elastomer such as EPDM or neoprene, for example. Because it is elastomeric, the gasket 316 remains resilient and forms a good seal against the pane 310, while also forcing the pane against the surface 308 to maintain the engagement of the adhesive key 312 in the set-back portion 311 of the arm 304.

According to a further form of the invention, not shown, the single pane 310 in FIG. 12 could be replaced by a double-pane window assembly, with a gasket similar to the gasket 316 interposed between the double-pane window assembly and one of the arms of the rail.

The embodiments of FIGS. 11 and 12 have many advantages. They are lower in cost. It is not necessary to co-extrude two different parts having different degrees of hardness. Rather, a cheaper, simpler extrusion die can be used, thus operating faster and less expensively.

Better window performance and quality is also obtained. By laminating (keying) the glass to the frame, the frame is prevented from being pulled off of the glass. The dovetail-shaped adhesive channel and key provide a very reliable mechanical force to hold the frame to the pane, eliminating any need, as in the prior art, to apply an adhesive over the full length of the pane, which in itself can result in frame warpage due to the thermal expansion differential discussed above. Also, because the glass interlocks with the frame, it becomes a structural component of the entire assembly and thus helps to maintain the rigidity, squareness and straightness of the frame, and eliminates the need for any internal metal reinforcements. Optionally, however, internal reinforcements can be provided at the rails which meet in the center of the window when the window is closed, namely the top rail of the bottom sash and the bottom raile of the top sash, to resist the bending forces that may be created by extremely high wind loads.

Because a releasing agent is applied to the PVC extrusion, the adhesive key will adhere only to the glass, thus forming only the above-mentioned keyed connection between the pane and the frame. This allows linear slippage between the glass and the frame.

The conventional methods of sealing a glass pane to a frame, by use of vinyl fingers under pressure and so forth, do not provide an effective, long-term seal against air and water penetration. The propensity of all thermoplastics to "creep" under pressure and time, particularly when subjected to several seasons of temperature extremes, results in a loss of pressure contact with the glass, thus allowing water and air to bypass the seals. In the embodiment of FIG. 11, on the other hand, a better seal is provided between the holding surfaces 264, 266 and the corresponding parts of the panes, since the holding surfaces apply a substantial pressure to the surfaces of the panes over a significant surface area. The adhesive key is not necessarily intended to be a full-perimeter seal, although it does eliminate air and water penetration in proportion to the length of the perimeter to which it has been applied, providing better overall sealing than conventional methods.

Full-length adhesive methods of attaching window panes to rails and stiles have been attempted, as referred to hereinabove, but without much success. These have mainly been afterthoughts based on existing designs, and as mentioned, they led to the problems of stress cracking of the glass, deglazing, differential warping and/or shearing stresses, and cosmetic problems caused by the external visibility of these adhesion methods.

Stop Elements

Figure 5:
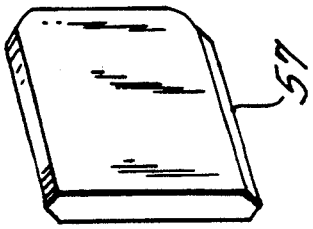
FIG. 5 is a perspective view of a thin stop element that extends from the jambs into the narrow space between the inner and outer sash units.

Referring again to FIGS. 3 and 4, at a location approximately one-quarter of the way up on jambs 12, 13 a thin stop element 59 (FIG. 5) is secured in the space 58 between channels 29 and 34 so that the stop members 59 project inward from jambs 12, 13 and extend adjacent the outer surfaces of stiles 23, 24 for inner sash unit 20. With the latter in its down or closed position, a stop element 59 projects from each jamb 12, 13 and is disposed approximately midway between upper rail 22 and lower rail 21 of the inner sash unit 20. In this stepless frame construction, these two stop elements 59 advantageously prevent outward deflection of stiles 23, 24 of inner sash 20 during negative wind load situations (pressure outside lower than pressure inside). For the outer sash 17, under negative pressure conditions, longitudinally extending formations 195 on the outer sides of jambs 11, 12 block deflection of its stiles 23, 24.

Sill Engagement

As best seen in FIG. 2, the upper wall 97 of sill 14 provides a stepless smooth upper drainage surface 96 which slopes downwardly from its inside or rear portion to its outside or front portion. A lip 95 is disposed along the inside of sill 96 and extends vertically upward therefrom. A bead 94 extends along the upper edge of lip 95 and protrudes to the rear thereof for cooperation with another latching bead 93 that extends downward from lifting ledge 92. The latter projects rearward from lower rail 21 and passes inward from the sash, above the lip 95, with bead 93 being disposed inside or to the rear of bead 94. Under normal pressure conditions beads 93, 94 are in a passive relationship so that they slide freely, past one another, as inner sash 20 is raised and lowered. However, under negative pressure conditions beads 93, 94 engage and cooperate to block deflection of lower rail 21 toward the outside of the window assembly 10.

Sealing Means

To close a gap 90 between surface 96 and rail 21, a brush-type or plush sealing strip 89 extends downward from lower rail 21 near the rear thereof and a resilient sealing strip 88 extends downward from lower rail 21 at the front thereof. Strip 88 is a single rubber-like element that flares outwardly from lower rail 21 so that air moving toward the gap 90 at the front thereof exerts a force on strip 88 tending to close same to the surface 96.

Additional slots are provided in the sash forming elements of the inner and outer window units 17, 20 to hold additional sealing strips 87. It should be apparent to those skilled in the art that the sealing strip 89 may be replaced by any other type of seal, such as a bulb-type or brush-type seal.

Stop Springs

As shown in FIG. 4, each of the stiles 23, 24 of the inner sash 20 has an individual deflectable stop spring 70 (FIGS. 1 and 6–7B) mounted at a point intermediate its ends, which is constructed of resilient sheet metal. Each spring 70 includes a generally trapezoidal main section 71 having two parallel sides and two diagonal sides. A pair of short ears 72 extend from the main section 71 at opposite ends of its shorter parallel side. Located along the latter and extending generally perpendicular to the main section 71, is a mounting tab 77 which is received by a slot 79 in stile 23 or 24, as the case may be. Tangs 78 on tab 77 position the spring 70 so that the diagonal sides of main section 71 are in contact with an outer side surface 24*a* of stile 24. Longer parallel side 73 of main section 71 is bowed away from the surface 24*a* and is generally parallel to the rear edge of stile 24.

With this arrangement, main section 71 provides a plurality of camming surfaces. A first camming surface 71*a* permits window unit 20 to be tilted into its vertical sliding position. Two additional camming surfaces 71*b*, 71*b* permit window unit 20 to slide vertically.

For example, when inner sash unit 20 is pivoted upward and forward to its vertical position, camming surface 71*a* engages and slides along inner surface 32*a* (FIG. 4) of inner wall section 32 to somewhat compress the bulging of main section 71 (FIG. 7A) because of the narrow space 74 between stile 24 and inner wall section 32. The resilient nature of spring 0 provides a biasing force so that there is frictional engagement between main section 71 and inner wall section 32 as inner window unit 20 slides up and down.

However, when inner window unit 20 is closed (in its fully downward position), spring 70 is in alignment with clearance notch 75 cut in the edge of inner wall section 32 that partially defines slot 28. Now main section 71 is free to bulge (FIG. 7B) to a thickness greater than that of space 74 and by so doing comes into a locking relationship with the outer edge 76 of inner wall section 32, at the clearance notch 75, so that a force acting inwardly on inner window unit 20, for example due to high winds outside the window, will be resisted by the engagement of stop member 71 with edge 76. The other camming areas 71*b*, 71*b* of spring 70 enable the latter to be somewhat compressed when the lower sash is raised, when main section 71 moves upward out of clearance notch 75.

While the stop springs 70 have been illustrated as having self-biasing properties, it should now be apparent to those skilled in the art that the springs 70 may be replaced by a relatively rigid cam element that is biased by one or more spring elements. Further, those skilled in the art should now recognize that the positions of springs 70 and their cooperating notches 75 may be reversed. That is, the springs 70 may be mounted on the jambs 11, 12 and the notches 75 may be in the stiles 23, 24.

With the unstepped frame depicted in FIGS. 3 and 4, the deflectable stop springs 70 preferably are only on the stiles 23, 24 of the inner sash 20. If they were employed on the outer sash 17, the outer sash 17 would not be able to freely tilt rearward, because the stop springs would tend to become caught on the jam channels 29.

A skilled individual will appreciate that without any springs 70 on the outer sash 17, the latter will tend not to resist inward wind loads as well as the inner sash 20. However, in this case additional stop elements 59 (not shown) can be added to the window assembly near the middle of the stiles 23, 24 of the outer sash, thereby adding to its wind load capacity. In such arrangement it is only necessary to lower the outer sash to a position below the additional stop elements 59 before it can be tilted inwardly.

Stepped Frame Construction

Figure 4A:
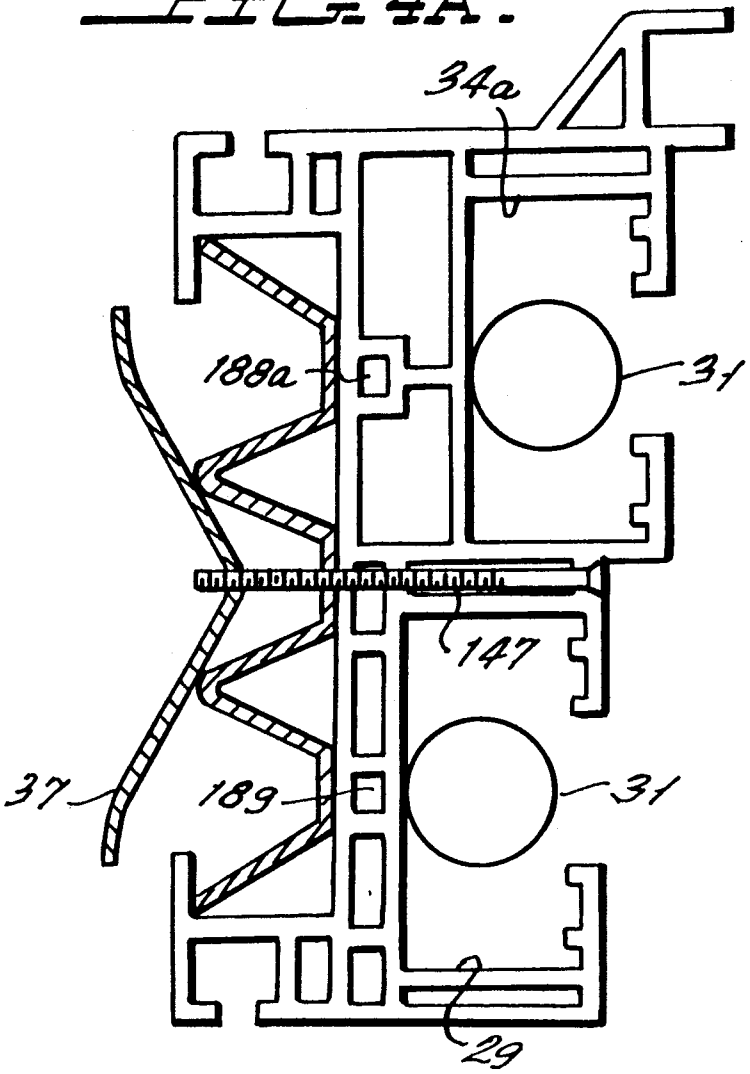
FIG. 4A is a partial horizontal cross-sectional view corresponding to part of FIG. 4, showing a stepped frame according to an alternate embodiment of the invention.
Figure 6:
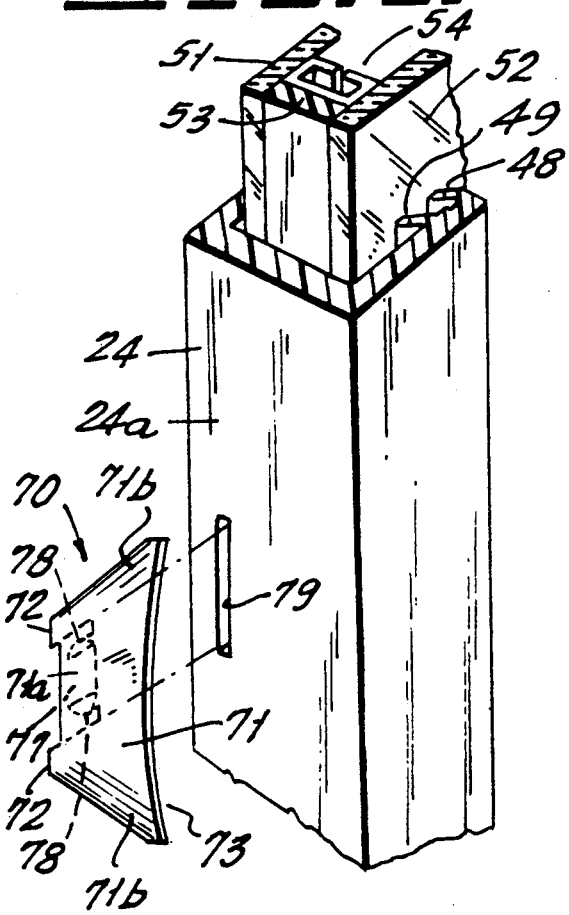
FIG. 6 is an exploded perspective view showing the relationship between a stile and a deflectable metal stop mounted thereon.
Figure 7A:
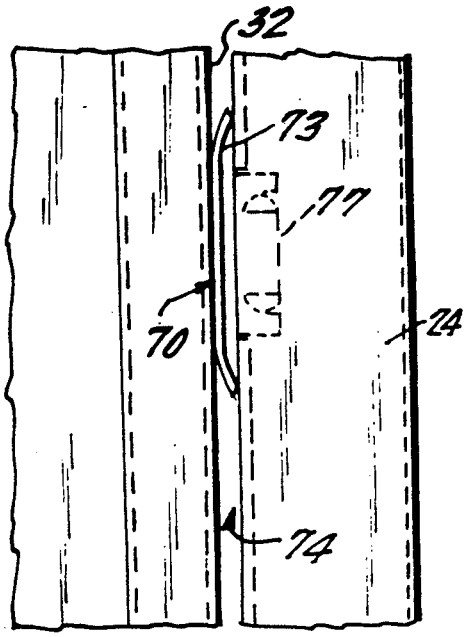
FIG. 7A is a side elevation showing the elements of FIG. 6 assembled with a window frame, with the deflectable stop spring in sliding contact with the jamb.
Figure 7C:
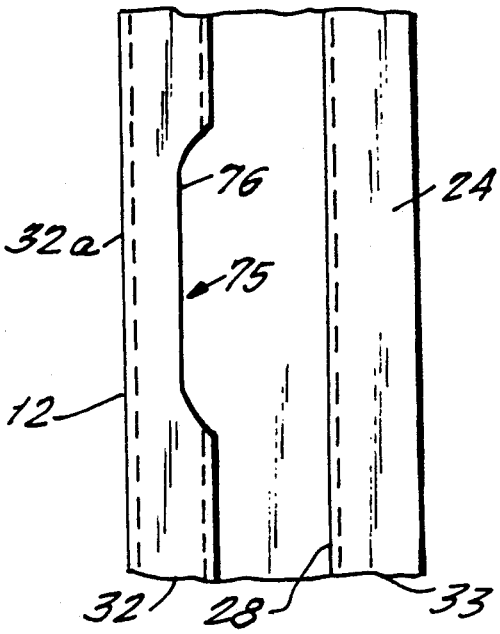
FIG. 7C is a fragmentary side elevation of the jamb looking in the direction of arrows 7C—7C of FIG. 7B.
Figure 7B:
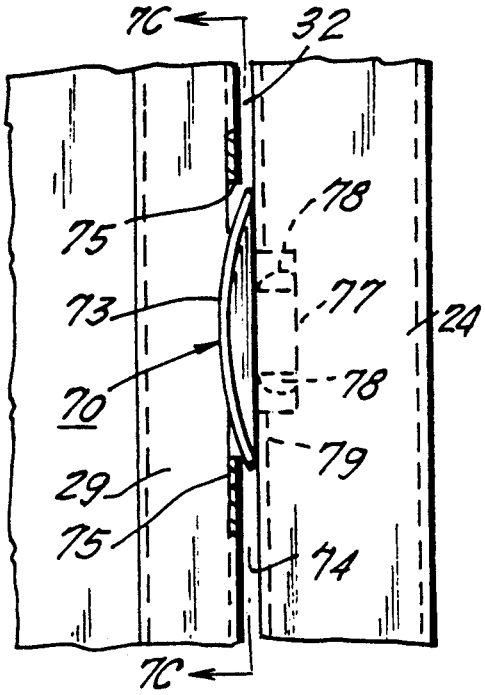
FIG. 7B is a side elevation showing the elements of FIG. 6 with the deflectable stop spring expanded by being aligned with a notch in the jamb.

FIG. 4A is a cross-sectional view similar to part of FIG. 4, but showing the construction of a stepped-type window frame, wherein the rectangular opening defined by the jambs, header and sill for accommodating the outer sash unit (not shown) is somewhat smaller in height and width than the opening for accommodating the inner sash unit (not shown). More specifically, the jamb channel 34*a* for the outer sash in FIG. 4A extends further from the periphery of the frame than does the analogous jamb channel 34 for the outer sash in FIG. 4. The jamb channel 29 for the inner sash is the same size in both FIG. 4 and FIG. 4A. In the embodiment of FIG. 4A the longitudinal passage 188*a* adjacent the jamb channel 34*a* is adapted to receive a respective screw 186, just as the passage 188 in FIG. 4. Also in this embodiment, no stop elements 59 are needed or used for the purpose of resisting outward (negative) pressure, since this function is provided by the stepped-type construction.

In this embodiment, the stop springs 70 can be employed on both sashes. That is, corresponding springs 70, 70 on outer sash 17 (FIG. 1) are aligned with and extend into additional clearance notches 75, 75 (not shown) when the outer sash 17 is in its fully raised (closed) position.

Although the present invention has been described in connection with a plurality of preferred embodiments thereof, the appended claims are not to be construed as being limited to such embodiments or to the specific disclosure herein. Rather, many other variations and modifications will now become apparent to those skilled in the art, fairly within the spirit and scope of the invention.

What is claimed:

1. A window assembly including a frame, said frame defining a rectangular opening;

an outer sash unit mounted to said frame and an inner sash unit mounted to said frame;

said sash units being disposed in said rectangular opening;

said frame comprising a pair of opposed parallel jambs, a still overlapping said jambs at their lower ends, and a header overlapping said jambs at their upper ends, said jambs, said sill and said header each comprising extruded elements;

wherein a selected pair of first and second extruded elements of said frame, which are opposite to each other across said rectangular opening, each define a longitudinal channel; and a metal beam-like reinforcing member is disposed within said channel so as to reinforce said selected pair of extruded elements;

the selected first and second extruded elements being said jambs; and further comprising jamb adjusting means disposed in engagement with said reinforcing members on a side thereof away from said rectangular opening.

2. A window assembly as in claim 1, in which the selected first and second extruded elements are said jambs, said jambs being longer than said sill and header, and each of the reinforcing members has a zig-zag cross-section.

3. A window assembly as in claim 1, wherein the remaining third and fourth extruded elements of said frame each define a longitudinal channel; and further comprising an additional metal beam-like reinforcing member disposed in each of said channels in said third and fourth extruded elements.

4. A window assembly as in claim 3, in which said additional reinforcing members are generally tubular.

5. A window assembly as in claim 4, in which each of said first and second members has a generally rectangular cross-section and is disposed within a channel having a generally rectangular cross-section.

6. A window assembly as in claim 1, in which said inner sash unit includes spaced parallel upper and lower rails connected by spaced parallel first and second stiles; said rails and stiles each comprising an extruded element;

a metal beam-like reinforcing member being disposed within said upper rail and extending longitudinally thereof and reinforcing said upper rail.

7. A window assembly as in claim 6, in which the reinforcing element disposed within the upper rail has a generally U-shaped cross-section.

8. A window assembly as in claim 6, wherein said inner sash unit is slidably mounted in said frame.

9. A window assembly as in claim 8, said inner sash unit being pivoted at said lower rail with respect to said frame.

10. A window assembly as in claim 6, in which said outer sash unit includes spaced parallel upper and lower rails connected by spaced parallel first and second stiles;

said rails and said stiles each comprising an extruded element; and a metal beam-like reinforcing element being disposed within said lower rail of said outer sash unit and extending longitudinally thereof and reinforcing said lower rail.

11. A window assembly as in claim 1, said sill being stepless and including a main upper surface having a generally uniform inside-to-outside downward slope from an inner vertical plane at the inner side of said inner sash unit to an outer vertical plane at the outer side of said outer sash unit.

12. A window assembly as in claim 11, wherein the spacing between said jambs is substantially the same adjacent said inner sash and said outer sash.

13. A window assembly including a frame, said frame defining a rectangular opening;

an outer sash unit mounted to said frame and an inner sash unit mounted to said frame;

said sash units being disposed in said rectangular opening;

said frame comprising a pair of opposed parallel jambs, a sill overlapping said jambs at their lower ends, and a header overlapping said jambs at their upper ends;

said jambs, said sill and said header each comprising extruded elements;

wherein a selected pair of first and second extruded elements of said frame, which are opposite to each other across said rectangular opening, each define a longitudinal channel; and a metal beam-like reinforcing member is disposed within said channel so as to reinforce said selected pair of extruded elements;

in which the first and second extruded elements constitute said jambs, said jambs being longer than said sill and header, and each of the reinforcing members has a zig-zag cross-section.

14. A window assembly as in claim 13, in which the first and second extruded elements constitute said jambs; and further comprising jamb adjusting means disposed in engagement with said reinforcing members on a side thereof away from said rectangular opening.

15. A window assembly including a frame defining a rectangular opening;

an outer sash unit mounted to said frame and an inner sash unit slidably mounted on said frame;

said sash units being disposed in said rectangular opening;

said frame comprising a pair of opposed parallel jambs, a sill overlapping said jambs at their lower ends, and a header overlapping said jambs at their upper ends;

said jambs, said sill and said header each comprising extruded elements;

said inner sash unit including spaced parallel upper and lower rails connected by spaced parallel first and second stiles;

said rails and said stiles each comprising an extruded element;

said sill being stepless and including a main upper surface having a generally uniform inside-to-outside downward slope from an inner vertical plane at the inner side of said inner sash unit to an outer vertical plane at the outer side of said outer sash unit;

wherein the spacing between said jambs is substantially the same adjacent said inner sash and said outer sash; and in which the sill also includes a first lip projecting upward from the main upper surface and extending along its inner edge, a first bead extending rearward from said lip along its upper edge;

a lifting ledge extending lengthwise of said lower rail and projecting rearward therefrom beyond said lip of said sill, a second lip extending from said lifting ledge and projecting downward therefrom and having a second bead disposed on the front of the second lip at its lower edge, such that said second bead normally closely bypasses said first bead without interference as said inner sash unit is moved into and out of its closed position, wherein said lower rail is adjacent said main upper surface;

said first and second beads being close to one another when said inner sash unit is in its said closed position, so that under negative pressure conditions said beads engage and thereby limit the forward deflection of said lower rail of said sash unit.

16. A window assembly as in claim 15, in which a narrow gap is defined between the main upper surface of the sill and the lower rail when said inner sash unit is in said closed position; and further comprising sealing means carried by said lower rail and extending longitudinally thereof, engaging said main upper surface of said sill and thereby sealing off said gap.

17. A window assembly as in claim 16, wherein said sealing means comprises a single element in the form of a deflectable strip that is disposed toward the outside of said lower rail.

18. A window assembly as in claim 16, wherein said sealing means comprises a strip of brushlike material.

19. A window assembly as in claim 15, in which said first and second beads extend across a substantial portion of the length of the lower rail.

20. A window assembly including a frame defining a rectangular opening, an outer sash unit mounted to said frame and an inner sash unit slidably mounted to said frame;

said sash units being disposed in said rectangular opening;

said frame comprising a pair of opposed parallel jambs, a sill overlapping said jambs at their lower ends, and a header overlapping said jambs at their upper ends;

said jambs, said sill and said header each comprising extruded elements;

each of said inner and outer sash units comprising spaced parallel upper and lower rails connected by spaced parallel first and second stiles;

said rails and said stiles each comprising an extruded element;

a pair of wind load stop means respectively projecting inward from said jambs into said rectangular opening, at such a location that with said inner sash unit substantially fully closed, said wind load stop means are adjacent the front surfaces of said stiles of said inner sash unit at respective points along the length thereof and resist an outward movement of the inner sash unit.

21. A window assembly as in claim 20, in which each wind load stop means comprises a plate-like element projecting from each of the jambs into said rectangular opening.

22. A window assembly as in claim 21, in which each said plate like element projects form a limited vertical portion of its respective jamb.

23. A window assembly as in claim 20, further comprising a second pair of wind load stop means projecting from said jambs adjacent the rear surfaces of said stiles of said outer sash unit.

24. A window assembly including a frame defining a rectangular opening;

an outer sash unit mounted to said frame and an inner sash unit slidably mounted to said frame;

said sash units being disposed in said rectangular opening;

said frame comprising a pair of opposed parallel jambs, a sill overlapping said jambs at their lower ends, and a header overlapping said jambs at their upper ends;

said jambs, said sill and said header each comprising extruded elements;

each of said sash units comprising spaced parallel upper and lower rails connected by spaced parallel first and second stiles;

said rails and said stiles each comprising an extruded element;

a respective hurricane stop means on each of said stiles of at least said inner sash unit and projecting sideways therefrom;

said hurricane stop means being disposed to engage said jambs and cooperate therewith to limit rearward deflection of said stiles of said inner sash unit when closed and when subjected to a rearward directed force;

in which each hurricane stop means comprises a deflectable unit including a sheet metal spring, a means for mounting said sheet metal spring by only a single mounting hole on each of said stiles, and normally projecting outward of the sash;

each of said jambs having a longitudinal guide channel defined partially by channel wall means facing said rectangular space and having a longitudinal slot which divides said channel wall means into coplanar front and rear wall sections; and said rear wall section having its front edge disposed to be engaged by said deflectable unit when the latter is in its fully projected position to block inward movement of said inner sash unit when the latter is subjected to an inwardly directed force.

25. A window assembly as in claim 24, in which each of said channel wall means is provided with a clearance notch;

said notches being aligned with said deflectable units when the inner window unit is in its closed position to permit said units to assume their fully projected positions; and when said inner window unit is disposed out of said closed position, said deflectable units being deflected inward from their fully projected positions by coming into frictional engagement with the channel wall means on the jambs.

26. A window assembly as in claim 25, in which each of said deflectable units includes cam surface means that are engaged by said channel wall means to deflect said deflectable units when said inner window unit is tilted to its vertical operating position and when said inner window unit slides upward from its closed position.

27. A window assembly including a frame defining a rectangular opening; an outer sash unit mounted to said frame and an inner sash unit slidably mounted to said frame;

said sash units being disposed in said rectangular opening;

said frame comprising a pair of opposed parallel jambs, a sill overlapping said jambs at their lower ends, and a header overlapping said jambs at their upper ends;

said jambs, said sill and said header each comprising extruded elements;

each of said sash units comprising spaced parallel upper and lower rails connected by spaced parallel first and second stiles;

said rails and said stiles each comprising an extruded element;

a respective hurricane stop means on each of said stiles of at least said inner sash unit and projecting sideways therefrom;

said hurricane stop means being disposed to engage said jambs and cooperate therewith to limit rearward deflection of said stiles of said inner sash unit when closed and when subjected to a rearward directed force;

in which each hurricane stop means comprises a deflectable unit mounted on each of said stiles and normally projecting outward of the sash;

each of said jambs having a longitudinal guide channel defined partially by channel wall means facing said rectangular space and having a longitudinal slot which divides said channel wall means into coplanar front and rear wall sections; and said rear wall section having its front edge disposed to be engaged by said deflectable unit when the latter is in its fully projected position to block inward movement of said inner sash unit when the latter is subjected to an inwardly directed force;

in which each of said channel wall means is provided with a clearance notch;

said notches being aligned with said deflectable units when the inner window unit is in its closed position to permit said units to assume their fully projected positions; and when said inner window unit is disposed out of said closed position, said deflectable units being deflected inward from their fully projected positions by coming into frictional engagement with the channel wall means on the jambs;

in which each of said deflectable units includes cam surface means that are engaged by said channel wall means to deflect said deflectable units when said inner window unit is tilted to its vertical operating position and when said inner window unit slides upward from its closed position;

said inner sash unit being pivoted at said lower rail with respect to said frame;

a pivot block being disposed in each of said channels and movable longitudinally therein, and a pivot bar projecting sideways from each of said stiles of said inner sash unit at its lower end into operative engagement with said pivot blocks; and each of said deflectable units includes a sheet metal element that is bent to bow away from said stiles;

said sheet metal elements when aligned with said clearance notches assuming their fully projected positions;

said sheet metal elements when engaged with said wall means being partially deflected from said fully projected positions toward said stiles to permit said inner sash unit to slide in said frame and to be tilted.

28. A window assembly as in claim 27, wherein the spacing between said jambs is smaller adjacent said outer sash unit than adjacent said inner sash unit; and further comprising a respective hurricane stop means on each of said stiles of said outer sash unit.

29. In combination, a rail or stile construction for receiving an edge of a window pane assembly, and a window pane assembly therein which includes at least a first pane, said rail or stile construction comprising:

a main body portion; a pair of arms projecting from the main body portion and defining a channel which is sized for receiving the edge of the window pane assembly;

at least a first one of said arms defining a holding surface spaced away from the main body portion; said holding surface being configured and disposed for contacting said window pane assembly over a two-dimensional contact area;

said first pane having a chevron-shaped adhesive key adhered thereto; said adhesive key being made of a material which bonds to the first pane and becomes a structural part thereof; and said first arm defines a chevron-shaped channel in which said adhesive key is engaged.

30. A construction as in claim 29, wherein said holding surface is formed by an enlarged portion of said first arm spaced away from the main body portion of said first arm; said chevron-shaped channel being defined between the enlarged portion and the main body portion.

31. A construction as in claim 29, wherein said window pane assembly further comprises a resilient spacer which spaces said first pane from the second one of said arms.

32. A construction as in claim 29, wherein said window pane assembly comprises two panes spaced apart by a spacer; a first one of said panes contacting said holding surface; said spacer facing said holding surface and being separated therefrom by the thickness of said first pane.

33. A construction as in claim 32, further comprising a resilient spacer disposed between said second pane and the second of said arms.

34. A window assembly as in claim 29, wherein said adhesive key is made of a silicone adhesive which bonds to the pane.

35. A window assembly as in claim 34, wherein a releasing agent is applied between the adhesive key and the channel in which the adhesive key is engaged and prevents substantial bonding between the adhesive key and the first arm.

36. A window assembly as in claim 29, wherein said adhesive key extends at least about 25 percent of the length of said rail or stile.

37. A window assembly as in claim 26, wherein said adhesive key extends at least about 70 percent of the length of said rail or stile.

38. A window assembly as in claim 29, wherein said adhesive key is formed on an inward-facing surface of said first pane.

39. A rail or stile construction for receiving an edge of a window pane assembly, comprising:

a main body portion; a pair of arms projecting from the main body portion and defining a channel which is sized for receiving the edge of the window pane assembly;

at least a first one of said arms defining a holding surface spaced away from the main body portion; said holding surface being configured and disposed for contacting said window pane assembly over a two-dimensional contact area;

further comprising a window pane assembly received in said rail or stile construction, which includes at least a first pane having a chevron-shaped adhesive key adhered thereto; and said first arm defines a chevron-shaped channel in which said adhesive key is engaged;

wherein said window pane assembly comprises two panes spaced apart by a spacer; a first one of said panes contacting said holding surface; said spacer facing said holding surface and being separated therefrom by the thickness of said first pane;

wherein each of said arms defines a holding surface spaced away from the main body portion; and said two holding surfaces face each other across said channel whereby each contacts said window pane assembly over a two-dimensional contact area; each of said holding surfaces contacting a respective one of said panes of said window pane assembly; said holding surfaces each facing one of two opposite ends of said spacer; and said holding surfaces bearing on said window pane assembly and being held apart substantially only by said spacer and by the thicknesses of said two panes.

40. A construction as in claim 39, wherein said second pane has a chevron-shaped adhesive key adhered thereto; and said second arm defines a chevron-shaped channel in which said adhesive key is engaged.

41. A construction as in claim 40, wherein each said adhesive key extends at least about 25 percent of the length of said rail or stile.

42. A construction as in claim 41, wherein each said adhesive key extends at least about 70 percent of the length of said rail or stile.

43. A construction as in claim 40, wherein said rail or stile has substantially only three stiffening webs extending across the interior of the rail or stile; including first and second stiffening webs which extend across the interiors of the arms near the main body portion, and a third stiffening web which extends substantially through the middle of the main body portion substantially parallel to said panes.

44. A construction as in claim 43, wherein said main body portion also has a screw channel defined therein, which extends longitudinally of said rail or stile.

45. A construction as in claim 44, further comprising an adjoining rail or stile forming a mitered connection together with said first-mentioned rail or stile; an end portion of said screw channel receiving a screw which passes through an end portion of said adjoining rail or stile; whereby said adjoining rail or stile and said first-mentioned rail or stile being joined at said end portions substantially only by said one screw.

* * * * *